US008444439B2

(12) United States Patent
Cao et al.

(10) Patent No.: US 8,444,439 B2
(45) Date of Patent: May 21, 2013

(54) CONNECTOR MOUNTING APPARATUS HAVING A BRACKET WITH RECESSES ABUTTING RESISTING TABS OF A MEMBER RECEIVED THEREIN

(75) Inventors: Cong Cao, Shenzhen (CN); Ya-Ni Zhang, Shenzhen (CN); Cheng-Tao Wu, New Taipei (TW); Yi-Fang Wu, New Taipei (TW)

(73) Assignees: Hong Fu Jin Precision Industry (ShenZhen) Co., Ltd., Shenzhen (CN); Hon Hai Precision Industry Co., Ltd., New Taipei (TW)

( * ) Notice: Subject to any disclaimer, the term of this patent is extended or adjusted under 35 U.S.C. 154(b) by 0 days.

(21) Appl. No.: 13/274,548

(22) Filed: Oct. 17, 2011

(65) Prior Publication Data

US 2012/0238133 A1 Sep. 20, 2012

(30) Foreign Application Priority Data

Mar. 15, 2011 (CN) ..... 201110061306.4

(51) Int. Cl.
*H01R 4/66* (2006.01)
*H01R 13/648* (2006.01)

(52) U.S. Cl.
USPC ..... 439/607.35; 439/108

(58) Field of Classification Search
USPC ..... 439/607.28, 607.47, 607.55, 108
See application file for complete search history.

(56) References Cited

U.S. PATENT DOCUMENTS

| | | | | |
|---|---|---|---|---|
| 6,447,311 | B1 * | 9/2002 | Hu et al. | 439/108 |
| 6,533,615 | B2 * | 3/2003 | Koide et al. | 439/607.48 |
| 6,682,368 | B2 * | 1/2004 | Murr et al. | 439/607.28 |
| 7,258,565 | B2 * | 8/2007 | Huang et al. | 439/353 |
| 7,568,950 | B2 * | 8/2009 | Belopolsky et al. | 439/607.55 |
| 7,744,382 | B2 * | 6/2010 | Zheng et al. | 439/79 |
| 7,744,418 | B2 * | 6/2010 | He et al. | 439/607.35 |
| 8,187,036 | B2 * | 5/2012 | Fujiwara et al. | 439/607.47 |
| 8,262,397 | B1 * | 9/2012 | Van Der Steen | 439/159 |
| 2002/0142636 | A1 * | 10/2002 | Murr et al. | 439/108 |
| 2008/0020654 | A1 * | 1/2008 | He et al. | 439/855 |

* cited by examiner

*Primary Examiner* — Chandrika Prasad
(74) *Attorney, Agent, or Firm* — Altis Law Group, Inc.

(57) ABSTRACT

A connector mounting apparatus includes a mounting bracket and a receiving member. A receiving space is defined in the mounting bracket. The receiving member includes a main body, a first resilient resisting tab extending outward from a base panel of the main body, and a first resilient contacting tab extending inward from the base panel to resiliently abut a connector interface received inside the main body. The main body is received in the receiving space and the first resisting tab resiliently abuts an inner surface of the receiving space.

9 Claims, 3 Drawing Sheets

CONNECTOR MOUNTING APPARATUS HAVING A BRACKET WITH RECESSES ABUTTING RESISTING TABS OF A MEMBER RECEIVED THEREIN

BACKGROUND

1. Technical Field

The disclosure generally relates to connector mounting apparatus, especially, to a connector mounting apparatus with EMI (electromagnetic interference) shielding clips.

2. Description of Related Art

Equipped with removable covers, electronic components with USB interfaces are normally encased within a metal enclosure. Despite providing an "outer skin" for the computer, the removable covers are not shielded. The encased electronic components are prone to leak electromagnetic interference through the covers. Such electromagnetic interference can interfere with other electronic components outside the enclosure. Thus, shielding components with an electromagnetic conductive material is often necessary.

Thus, there is room for improvement within the art.

DETAILED DESCRIPTION

The disclosure is illustrated by way of example and not by way of limitation in the figures of the accompanying drawings in which like references indicate similar elements. It should be noted that references to "an" or "one" embodiment in this disclosure are not necessarily to the same embodiment, and such references mean at least one.

Figure 1:
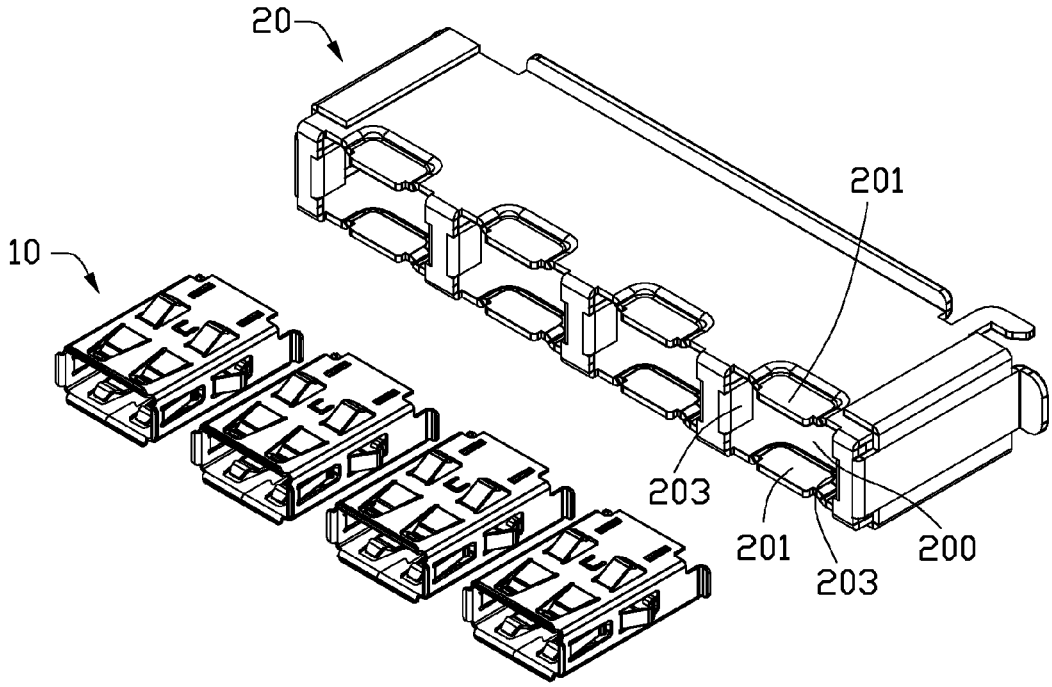
FIG. 1 is an exploded, isometric view of an embodiment of a connector mounting apparatus.

Referring to FIG. 1, one embodiment of a connector mounting apparatus is shown. In this example, the connector mounting apparatus includes four receiving members 10 and a mounting bracket 20 for mounting the four receiving members 10. Each receiving member 10 is a socket used for receiving a connector interface.

Figure 2:
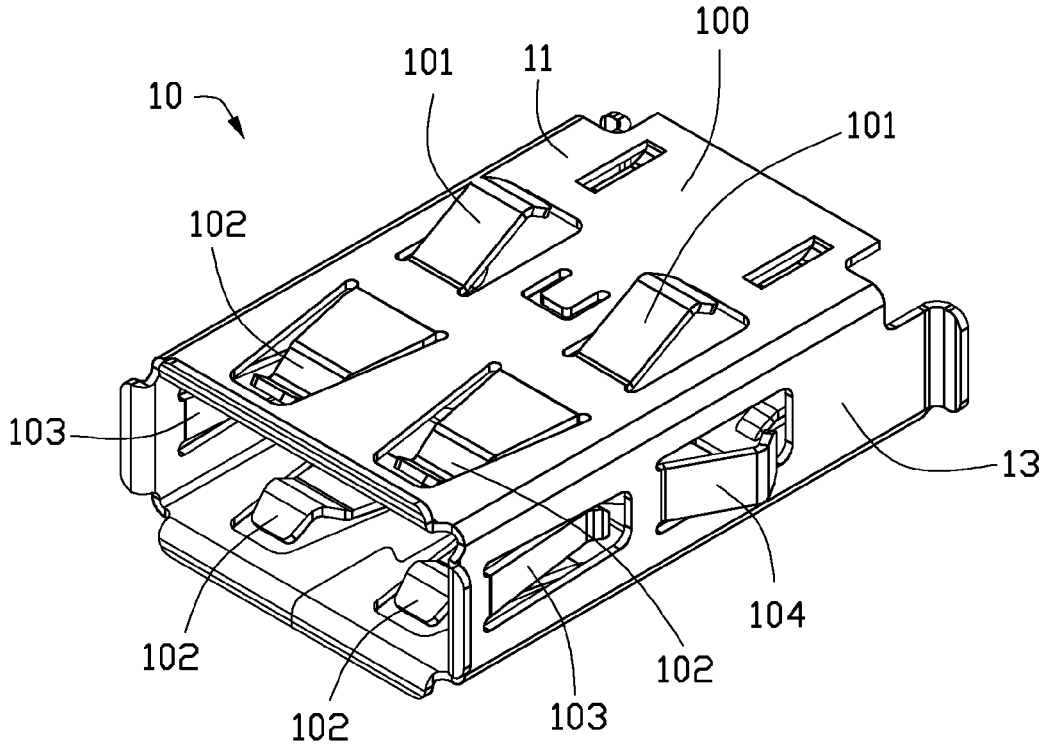
FIG. 2 is an isometric view of a securing bracket of the connector mounting apparatus of FIG. 1.

Referring to FIG. 2, each receiving member 10 includes a hollow main body 100. The main body 100 includes two base panels 11 and two side panels 13. The base panels 11 are parallel to each other. The side panels 13 are parallel to each other and perpendicular to the base panels 11. A front opening (not labeled) and a back opening (not shown) are surrounded by the side panels 13 and the base panels 11. The front opening is used for receiving a connector. In one embodiment, the connector is a USB connector. The back opening is used for receiving cables connected to a printed circuit board. Each receiving member 10 includes two first resilient resisting tabs 101 extending out from each base panel 11 and two first resilient contacting tabs 102 extending toward the opposite base panel 11. Each receiving member 10 includes a second resilient resisting tabs 104 extending out from each side panel 13 and a second resilient contacting tab 103 extending toward the opposite side panel 13. The first and second resilient contacting tabs 102, 103 are used for contacting the connector interface. The extending direction of the first resilient contacting tab 102 is substantially opposite to the extending direction of the second resilient contacting tab 103 and the extending direction of the first resilient resisting tab 101. The extending direction of the first resilient resisting tab 101 is substantially parallel to the extending direction of the second resilient resisting tab 104. Free ends of the first resilient resisting tabs 101 and the first resilient contacting tabs 102 extend towards the corresponding base panel 11. Free ends of the second resilient resisting tab 104 and the second resilient contacting tab 103 extends towards the corresponding side panel 13.

Four receiving spaces 200 is defined in the mounting bracket 20 corresponding to the four receiving members 10. Each receiving space 200 is surrounded by two parallel mounting panels 201 and two parallel recess portions 203.

Figure 3:
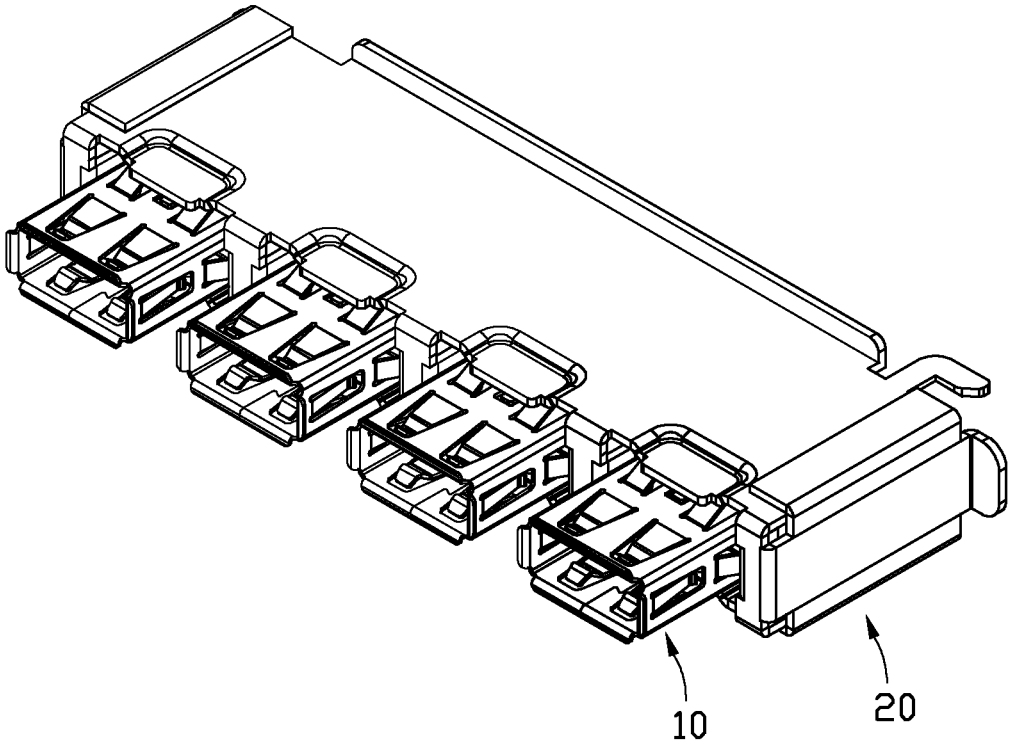
FIG. 3 is a view of an assembled connector mounting apparatus of FIG. 1.

Referring to FIGS. 1 to 3, in assembly, each receiving member 10 is aligned with a corresponding receiving space 200. The receiving members 10 moves close to the mounting bracket 20 to enable the receiving members 10 to be received in the receiving spaces 200. At this time, the first resilient resisting tabs 101 abut the mounting panels 201 and the second resilient resisting tabs 104 abut the recess portions 203, providing EMI shielding.

It is to be understood, however, that even though numerous characteristics and advantages have been set forth in the foregoing description of embodiments, together with details of the structures and functions of the embodiments, the disclosure is illustrative only, and changes may be made in detail, especially in the matters of shape, size, and arrangement of parts within the principles of the disclosure to the full extent indicated by the broad general meaning of the terms in which the appended claims are expressed.

What is claimed is:

1. A connector mounting apparatus, comprising:

a mounting bracket, the mounting bracket defining a receiving space; and a receiving member, the receiving member comprising a main body, a first resilient resisting tab extending outward from a base panel of the main body, and a first resilient contacting tab extending inward from the base panel to resiliently abut a connector interface to be received inside the main body; the main body received in the receiving space and the first resilient resisting tab resiliently abutting an inner surface of the receiving space;

wherein the main body further comprises a side panel extending from the base panel, and the receiving member further comprises a second resilient resisting tab extending outward from the side panel; the side panel substantially perpendicular to the base panel; the second resilient resisting tab resiliently abuts a second inner surface of the receiving space; the receiving member further comprises a second resilient contacting tab extending inward from the side panel; the second resilient contacting tab is adapted to resiliently abut the connector interface; the mounting bracket comprises two recess portions for surrounding the receiving space; the receiving member is received between the two recess portions; and the second resilient resisting tab resiliently abutting one of the two recess portions.

2. The connector mounting apparatus of claim 1, wherein free ends of the second resilient resisting tab and the second resilient contacting tab extend in opposite directions from their respective side panels.

3. A connector mounting apparatus, comprising:

a mounting bracket, a receiving space defined in the mounting bracket; and a receiving member, the receiving member comprising a main body and a first resilient resisting tab and a second resilient resisting tab extending outward from the main body; the main body being hollow to receive a connector interface; the main body received in the receiving space; the first resilient resisting tab resiliently abuts the mounting bracket to prevent the main body from moving in a first direction and the second resilient resisting tab resiliently abuts the mounting bracket to prevent the main body from moving in a second direction substantially perpendicular to the first direction;

wherein the mounting bracket comprises two recess portions for surrounding the receiving space; the receiving member is received between the two recess portions; and the second resilient resisting tab resiliently abutting one of the two recess portions.

4. The connector mounting apparatus of claim 3, wherein the main body comprising a base panel and a side panel extending from the base panel; the side panel substantially perpendicular to the base panel; the first resilient resisting tab extends outward from the base panel and the second resilient resisting tab extends outward from the side panel.

5. The connector mounting apparatus of claim 4, wherein the receiving member further comprises a first resilient contacting tab extending inward from the base panel and a second resilient contacting tab extending inward from the side panel; the first resilient contacting tab and the second resilient contacting tab adapted to resiliently abut the connector interface.

6. The connector mounting apparatus of claim 5, wherein free ends of the second resilient resisting tab and the second resilient contacting tab extend toward the side panel.

7. The connector mounting apparatus of claim 5, wherein an extending direction of the first resilient resisting tab is substantially opposite to an extending direction of the first resilient contacting tab.

8. The connector mounting apparatus of claim 5, wherein free ends of the first resilient resisting tab and the first resilient contacting tab extend toward the base panel.

9. The connector mounting apparatus of claim 3, wherein the mounting bracket comprises two mounting panels for surrounding the receiving space; the receiving member is received between the two mounting panels; and the first resilient resisting tab resiliently abutting one of the two mounting panels.

* * * * *